United States Patent [19]

Barba

[11] Patent Number: 4,549,910

[45] Date of Patent: Oct. 29, 1985

[54] PROCESS FOR THE PROTECTIVE SEALING OF ANODIC ALUMINUM OXIDE AND ITS ALLOYS WHICH CONFERS A PARTICULAR RESISTANCE TO AGRESSIVE ALKALINE AGENTS

[75] Inventor: Walter D. Barba, Modena, Italy

[73] Assignee: Aeromarine Technology, Inc., Tustin, Calif.

[21] Appl. No.: 498,621

[22] Filed: May 27, 1983

[30] Foreign Application Priority Data

Jun. 28, 1982 [IT] Italy ..... 40070 A/82

[51] Int. Cl.[4] ..... C25D 11/18

[52] U.S. Cl. ..... 148/6.27; 204/37.6; 204/38.3

[58] Field of Search ..... 204/35 N, 38 A; 148/627; 427/343, 419.2

[56] References Cited

U.S. PATENT DOCUMENTS

| | | | |
|---|---|---|---|
| 3,494,839 | 2/1970 | Chambers et al. | 204/37.6 |
| 3,832,239 | 8/1974 | Hoch et al. | 204/37.6 |
| 3,852,124 | 12/1974 | Fassell | 148/6.15 |
| 3,935,349 | 1/1976 | Terai et al. | 427/409 |
| 4,208,223 | 6/1980 | Hofstatter | 148/6.2 |
| 4,225,398 | 9/1980 | Hasegawa et al. | 204/33 |
| 4,310,390 | 1/1982 | Bradley et al. | 204/37 R |

*Primary Examiner*—Andrew H. Metz
*Assistant Examiner*—William T. Leader
*Attorney, Agent, or Firm*—K. H. Boswell

[57] ABSTRACT

A process for sealing anodic oxide coating on aluminum and aluminum alloys wherein organic substances with hydrolyzable functional groups like organo-functional silanes react with water at room temperature forming a silantriolic compound [according to the reaction: $R'-Si(OCH_3)_3+3H_2O—R'-Si(OH)_3$] which in turn reacts with the oxide coating forming a stable chemical bridge between silicon and metal thusly:

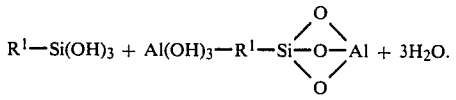

Analogously the silantriol reacts with oxides of other metals such as Fe, Mn, Sn, and Cu commonly used for coloring, forming stable chemical bridges and therefore sealing the color.

21 Claims, No Drawings

PROCESS FOR THE PROTECTIVE SEALING OF ANODIC ALUMINUM OXIDE AND ITS ALLOYS WHICH CONFERS A PARTICULAR RESISTANCE TO AGRESSIVE ALKALINE AGENTS

TECHNICAL FIELD

This invention relates generally to processes for sealing anodized aluminium and more particularly to a process for treating electrolytically formed anodic oxide on aluminium and aluminium alloys with the aim of conferring a satisfactory resistance to external corrosive agents, particularly the alkaline ones, a resitance superior to that obtained by traditional sealing methods using demineralized water or a nickel salts base.

BACKGROUND OF THE INVENTION

The anodization of aluminium and aluminium alloys leads to the formation of an oxide layer which has excellent adherence to the metal, a high level of flexibility and hardness, but, because of its porous structure, a weak resistance to external chemical agents. From this weakness derives the industrial treatment defined as "sealing", which gives the oxide a satisfactory resistance to external agents so as to render the manufactured products treated in this way useable for the most varied purposes, even in severe conditions. The sealing methods which have evolved from the beginning of the practice of anodic oxidation of aluminium and aluminium alloys are all different, but they mostly consist in the immersion of the anodized piece in demineralized water or in an aqueous solution containing nickel or cobalt salts at a temperature of about 100° C. for periods of time varying from half an hour to an hour, depending on the thickness of the oxide.

The generally accepted opinion is that in the sealing treatment the oxide is transformed into bohemite; this transformation occurs above 80° C. and its efficiency increases with the increase in the temperature. The theories on sealing are also different from the first simplistic idea that the sealing provokes the closing of the pores. It is now thought that the action is more complex, including a partial restriction of the pore and the formation of waterproof gel layers at the pore's base. The action of nickel and cobalt salts and other mineral salts is explained by their tendency to precipitate hydroxides in the pH conditions of the means used.

The prior art processes, while giving satisfactory results, do not however represent the maximum. These types of sealing, even when carried out in the best conditions, do not render the article resistant to the various corrosive elements in the environment, even the bland ones, and particularly not in the case of alkaline elements such as the lime for plaster and water soluble colours. Alkaline resistance is very important given the extensive use of aluminium oxide in the building industry.

Further, the costs of the prior art processes are high, given the remarkable consumption of energy to keep the temperature of the bath near boiling point; the cost of the steam process which is often used as an alternative is equally high.

It is therefore natural that for some time the industry has been trying to perfect anodic oxide treatment processes which will at the same time give better protection at lower cost.

SUMMARY OF THE INVENTION

The research has mainly been centered on the use of three classes of chemical compounds:

(a) Compounds with anti-corrosive "sealing" properties with molecular dimensions capable of entering by capillarity into the pores and coating the internal walls.

(b) Inert surface-active agents which lower the surface tension of the solvent and favour the entry of the type (a) compounds into the pores.

(c) Water repellent or waterproof substances which form an ulterior protective layer against the penetration of external agents.

The use of such classes of compounds may be separate but it is obviously preferable to use a combination in a single solution.

The present invention constitutes a further progress in the anodic oxide stabilization technique, in fact it uses in addition to the substances cited above, substances which are capable of reacting with the anodic oxide, forming stable compounds. Among these are the organic substances with hydrolyzable functional groups like organo-functional silanes of the type represented by the formula: $X—(CH_2)_y—Si—(OR)_3$ in which "X" is a functional group, preferably aminic; "OR" is an alcoholic group, preferably ethoxy; "y" is the number of atoms in a short paraffinic chain, preferably three. These react with water at room temperature freeing alcohol and forming a silantriolic compound according to the reaction:

$$R'—Si(OCH_3)_3+3H_2O—R'-Si(OH)_3+3CH_3OH$$

The silantriol therefore reacts with the aluminium oxide:

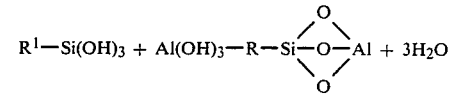

forming a chemical bridge between silicon and aluminium; analogously the silantriol reacts with oxides of other metals normally used for colouring, Fe, Mn, Sn, Cu, forming stable chemical bridges and therefore sealing the colour. The reaction between the silantriolic compounds and aluminum oxide and the oxides of other metals takes place in immersion times of a few minutes, preferably 8 to 12 minutes.

The most suitable silanes are those containing an aminic group and being soluble in water between 0.5 and 5%. One of the organo-functional silanes consists of amino propyltriethoxysilane in a concentration of between 0.1 and 10 grams per liter, preferably 0.3 grams per liter.

As far as the functional group is concerned, it must have dimensions such as to allow it to enter into the pores and it may be susceptible to further reactions.

A positive factor for the process is the presence of the cations $Ni^{++}$, $Co^{++}$, $Zr^{++}$, preferably Nickel, and in concentrations of between 0.1 and 10 g/l, anions or inorganic oxyanions, $F^-$, $SiF_6^=$, $CrO_4^=$, $WO_4^=$, $MoO_4^=$, preferably $F^-$ and at concentrations of between 0.5 and 5 g/l. The sealing solution may contain water repellant substances like silicic acid esters, preferably ethylsilicate in a concentration between 0.1 and 5 grams per liter.

The complete stability of the components of the protective sealing bath as described in the present invention makes the bath last for a practically unlimited time. With the aim of obtaining the best results for long periods of use it is sufficient to carry out simple checks and to replenish the solution in the bath periodically. These checks are simple to carry out for anyone who is familiar with anodic oxidation.

The first check is the pH check, the pH value must be kept between 5.5 and 6.5, and any adjustments are made by adding ammonia if its value falls below 5.5, or by adding acetic acid (or formic acid) if its value is more than 6.5.

The second check concerns the nickel ion concentration: as the bath is used there is a progressive impoverishment of its components due to both the introduction of water used for washing when the anodized pieces are put into the bath, and to the dragging of the solution when the pieces are taken out. This progressive dilution affects all the components of the bath in the same way, therefore it is sufficient to establish the quantity of any one of them to determine the amount necessary to replenish the solution and bring the bath back up to the required concentration. Nickel ion is the most convenient choice of indicator in that its determination is simple and known to anyone with any experience in anodic oxidation. We recommend the complexometric titration method with ethylenediamine tetraacetic acid (E.D.T.A.) using murexide as indicator.

The replenishment may be carried out with the seperate products or with a concentrated solution of all of them.

BEST MODE FOR CARRYING OUT THE INVENTION

As an illustration of the invention, the two following examples of the application of the protective sealing method are disclosed for the stabilization of anodic oxide.

EXAMPLE 1

A small aluminium alloy plate (P—Al—Si Mg(UNI-3569)) measuring $6\times12\times0.2$ cm. was degreased, pickled in soda and washed, then placed in an oxidation bath of 17% $H_2SO_4$ (temp. 20° C.), oxidized at a current density of 1.5 A/dm$^2$, for 30 minutes, obtaining a deposit of about 15 microns.

To carry out the protective sealing: after extraction from the oxidation bath the plate is washed in demineralized water and immersed in the protective sealing bath which is kept at a temperature of 30° C. and has the following composition in grams per liter in demineralized water:

$Ni(COOH)_2.2H_2O=7$ gr/l.
$H_2SiF_6$ (d=1.31)=2 gr/l.
Ethyl silicate=1 gr/l.
γ aminopropyltriethoxysilane=0.3 gr/l.
Isobutylic alcohol=15 gr/l.
Temperature=30° C. (86° F.)
pH=between 5.5 and 6.5

After 10 minutes immersion the plate is extracted and washed in demineralized water; after 8 hours it can be submitted to quality testing.

EXAMPLE 2

A small aluminium plate with the same characteristics as the one described in Example 1 and anodized in the same conditions is washed in demineralized water and immersed in the protective sealing bath at 30° C. The bath has the following composition:

$Ni(HCOO)_2.2H_2O=7$ gr/l.
$NH_4F.HF=2$ gr/l.
Ethyl silicate=1 gr/l.
γ aminopropyltriethoxysilane=0.3 gr/l.
Isobutylic alcohol=15 gr/l.
Temperature=30° C. (86° F.)
pH=between 5.5 and 6.5

After 10 minutes immersion the plate is taken out and washed in demineralized water; after 8 hours it can be submitted for quality testing.

EXAMPLE 3

$NiF_2.4H_xO=6$ g/l.
γ aminopropyltriethoxysilane=0.2 g/l.
Isobutylic alcohol=5 g/l.
Ethylsilicate=1 g/l.

After 10 minutes immersion the plate is taken out and washed in demineralized water; after 8 hours it can be submitted for quality testing.

Standardized Quality Tests

The plates anodized and sealed according to the examples 1 and 2 and others oxidized as in examples 1 and 2 but sealed by the traditional method in demineralized water at 98° C. for 45 minutes, were submitted to the following quality tests: ISO 3120, ISO 2932, ACID TEST (KAPE), BS SULPHITE TEST.

The following table shows the average weight losses undergone by the plates sealed according to the three different methods.

| Method of Sealing | ISO3120 mg/dm$^2$ | ISO2932 mg/dm$^2$ | ACID TEST (KAPE) mg/dm$^2$ | BS SULPHITE TEST mg/dm$^2$ |
|---|---|---|---|---|
| a (ex. 1) | 10.2 | 13.8 | 11.1 | 6.0 |
| b (ex. 2) | 8.4 | 13.3 | 12.8 | 5.7 |
| c (demin. water 98° C. for 45 mi.) | 13.1 | 15.1 | 16.5 | 5.2 |
| Maximum Allowed | 30 | 20 | 20 | 20 |

The results obtained on the samples prepared according to the method described in the invention are clearly better than those obtained on the other samples. Only in the BS SULPHITE test the results are slightly inferior, but they are always below the maximum light allowed.

Alkaline Solution Resistance Test

To test alkaline solution resistance another three small aluminium plates were prepared, of which 2 were prepared as in example 1, while the third was sealed in the traditional way, in demineralized water at 98° C. for 45 minutes.

(1) A solution of NaOH 0.1 at pH=13.3 is prepared and the three samples, after 8 hours, are completely immersed for 20 minutes. The samples are then taken out, washed and air dried. On the sample sealed in demineralized water at 98° C. you can see an evident opaqueness which would indicate that the oxide has been attacked. The measurement of the oxide layer reveals a loss of 50% of its thickness. The plates fixed according to the example 1, after 20 minutes immersion do not yet show any signs of corrosion, and on measuring the thickness of the oxide no diminution is revealed.

(2) A saturated solution of CaO is prepared, and three plates prepared as in no. 1 are immersed in it at pH=12. After 40 minutes the samples are taken out, washed and air dried; in this case the samples sealed as in examples 1 and 2 show only slight signs of corrosion while the samples sealed in demineralized water at 98° C. for 45 minutes show a complete corrosion with a loss in thickness of the oxide of about 80%.

Industrial Applicability

It will be apparent to those skilled in the art that the process invention for sealing anodic oxide on aluminium and aluminium alloys and as disclosed herein may be modified or altered variously without departing from the teachings hereof and that the same shall be limited only by the spirit and scope of the appended claims.

I claim:

1. A process for sealing anodic oxide on aluminum and aluminum alloys consisting essentially of the step of: contacting anodically oxidized aluminum or aluminum alloys with a sealing solution comprising:

(a) inorganic ions selected from the group consisting of cations $Ni^{++}$, $Co^{++}$, $Zr^{++}$; anions $F^-$, $SiF_6^=$, $CrO_4^=$, $WO_4^=$, $MoO_4^=$; and mixtures of said cations and anions; and (b) a trialkyloxysilane represented by the formula: $X—(CH_2)_y—Si—(OR)_3$ in which "X" is a functional aminic group, "OR" is an alkoxy radical and "y" is 1 to 3.

2. A process according to claim 1, wherein said "OR" radical is ethoxy and "y" is equal to three.

3. A process according to claim 2, wherein the trialkyloxysilane is γ aminopropyltriethoxysilane in a concentration in the sealing solution of 0.1 to 10 grams per liter.

4. A process according to claim 3, wherein the γ aminopropyltriethoxysilane is in a concentration of 0.2 to 0.3 grams per liter.

5. A process according to claim 1, wherein the ions are $Ni^{++}$ ion in a concentration of between 0.1 and 10 grams per liter and $F^-$ ion in a concentration of between 0.5 and 5 grams per liter.

6. A process for sealing anodic oxide on aluminum and aluminum alloys comprising immersing anodically oxidized aluminum or aluminum alloys into a sealing solution comprising a nickel salt, isobutylic alcohol, and a trialkyloxysilane represented by the formula: $X—(CH_2)_y—Si—(OR)_3$ in which "X" is a functional aminic group, "OR" is an alkoxy radical and "y" is 1 to 3.

7. A process according to claim 6, wherein said "OR" radical is ethoxy and "y" is equal to three.

8. A process according to claim 7, wherein the trialkyloxysilane is γ aminopropyltriethoxysilane in a concentration of 0.1 to 10 grams per liter.

9. A process according to claim 8, wherein the γ aminopropyltriethoxysilane is in a concentration of 0.2 to 0.3 grams per liter.

10. A process according to claim 6, wherein the nickel salt is nickel formate in a concentration of about 7 grams per liter of sealing solution.

11. A process according to claim 6, wherein the nickel salt is nickel fluoride in a concentration of about 6 grams per liter of sealing solution.

12. A process according to claim 6, including an acidic fluoride compound in a concentration of about 2 grams per liter of sealing solution.

13. A process according to claim 12, wherein the acidic fluoride compound is fluosilicic acid.

14. A process according to claim 12, wherein the acidic fluoride compound is ammonium fluoride.hydrofluoric acid.

15. A process according to claim 6, including a water repellent substance consisting of silicic acid esters.

16. A process according to claim 15, wherein the silicic acid ester is ethylsilicate in a concentration of about 1 gram per liter of sealing solution.

17. A process according to claim 6, wherein the isobutylic alcohol is present in a concentration of from 5 to 15 grams per liter of sealing solution.

18. A process according to claim 6, wherein the sealing solution is at a temperature of about 30° C.

19. A process according to claim 6, wherein the anodically oxidized aluminum or aluminum alloys are immersed in the sealing solution for about 8 to 12 minutes.

20. A process according to claim 6, wherein the pH of the sealing solution is between 5.5 and 6.5.

21. A process for sealing anodic oxide on aluminum and aluminum alloys comprising: contacting anodically oxidized aluminum or aluminum alloys with a sealing solution comprising: $Ni^{++}$ ions, $F^-$ ions, and a trialkyloxysilane represented by the formula: $X—(CH_2)_y—Si—(OR)_3$ in which "X" is a functional aminic group, "OR" is an alkoxy radical and "y" is 1 to 3.

* * * * *